US008011743B2

(12) United States Patent
Nussbaumer et al.

(10) Patent No.: US 8,011,743 B2
(45) Date of Patent: Sep. 6, 2011

(54) DEVICE FOR INFLUENCING THE MOVEMENT OF FURNITURE PARTS WHICH CAN BE MOVED RELATIVE TO ONE ANOTHER, AND DRAWER GUIDE, AND METHOD OF PRODUCING THE DEVICE

(75) Inventors: Thomas Nussbaumer, Lingenau (AT); Markus Albrecht, Lustenau (AT); Jürgen Amann, Lustenau (AT)

(73) Assignee: Grass GmbH, Hochst/Voralberg (AT)

( * ) Notice: Subject to any disclaimer, the term of this patent is extended or adjusted under 35 U.S.C. 154(b) by 522 days.

(21) Appl. No.: 11/705,282

(22) Filed: Feb. 12, 2007

(65) Prior Publication Data

US 2007/0188060 A1 Aug. 16, 2007

(30) Foreign Application Priority Data

Feb. 13, 2006 (EP) ..... 06002815

(51) Int. Cl.
*A47B 95/00* (2006.01)

(52) U.S. Cl. ..... 312/333

(58) Field of Classification Search ..... 312/330.1, 312/333, 334.1, 334.7, 334.8, 334.44, 334.46, 312/334.47, 319.1; 384/21, 22
See application file for complete search history.

(56) References Cited

U.S. PATENT DOCUMENTS 5,695,262 A * 12/1997 Wachtler ..... 312/229
6,340,078 B1 * 1/2002 Scheible ..... 188/166
6,629,738 B2 * 10/2003 Salice ..... 312/333
6,655,612 B2 * 12/2003 Oliver ..... 239/585.4
6,672,692 B2 * 1/2004 Weng ..... 312/333
6,736,471 B2 * 5/2004 Lin ..... 312/333
6,846,053 B2 * 1/2005 Salice ..... 312/334.14
6,938,839 B2 * 9/2005 Xu et al. ..... 239/533.11
6,979,065 B2 * 12/2005 Egger ..... 312/333
(Continued)

FOREIGN PATENT DOCUMENTS

EP 1 127 514 A 8/2001
EP 1 625 810 A 2/2006

OTHER PUBLICATIONS

European Search Report dated Jul. 31, 2006 corresponding to EP 1 817 983 A1.

*Primary Examiner* — Darnell Jayne
*Assistant Examiner* — Timothy M Ayres
(74) *Attorney, Agent, or Firm* — Kilpatrick Townsend & Stockton LLP

(57) ABSTRACT

The invention proposes a device for influencing the movement of furniture parts (1, 2) which can be moved relative to one another, having a movement-influencing unit which comprises an installation housing, in which movement-influencing coupling means are accommodated such that they can be displaced at least in a translatory manner, and having a coupling element, to which the coupling means are connected in the operating state. In order to provide a device which is of space-saving construction and is comparatively straight-forward to install, the movement-influencing unit is designed such that, by virute of a relative movement between the coupling means and the coupling element in a displacement direction of the coupling means, the coupling means can be coupled to the coupling element to produce a connection which has a predeterminable coupling force. Also proposed are a drawer guide and a production method.

13 Claims, 5 Drawing Sheets

U.S. PATENT DOCUMENTS

2004/0104650 A1 6/2004 Egger
2004/0107536 A1* 6/2004 Hollenstein ..... 16/94 R
2004/0174101 A1* 9/2004 Lin ..... 312/333
2005/0098394 A1* 5/2005 Baldreich ..... 188/67
2006/0108901 A1* 5/2006 Mao-Chin ..... 312/334.44
2006/0186772 A1* 8/2006 Lam et al. ..... 312/333
2007/0046159 A1* 3/2007 Hoffman ..... 312/333
2007/0145163 A1* 6/2007 Manubolu et al. ..... 239/533.12

* cited by examiner

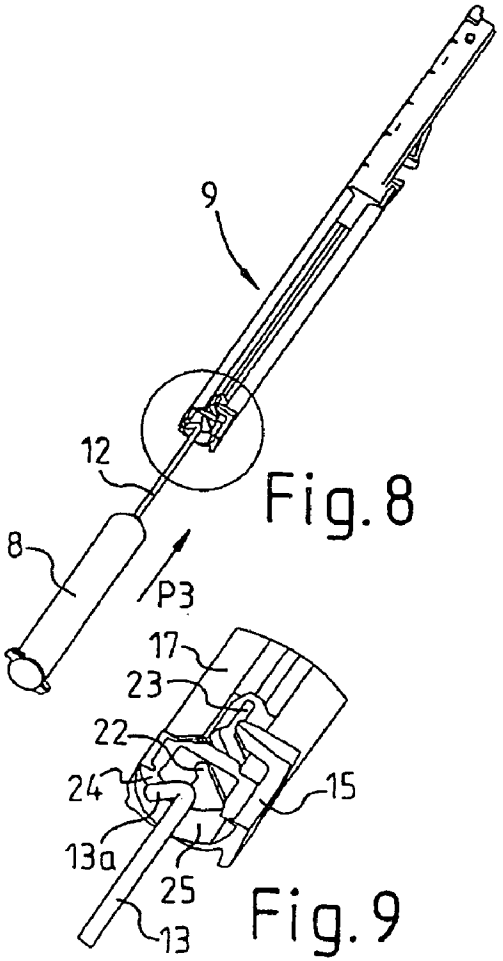
Fig. 8
Fig. 9
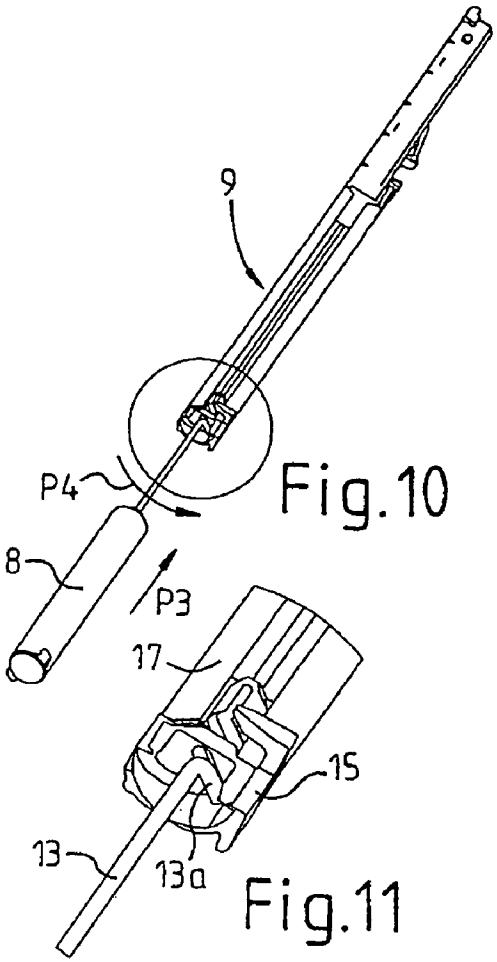
Fig. 10
Fig. 11
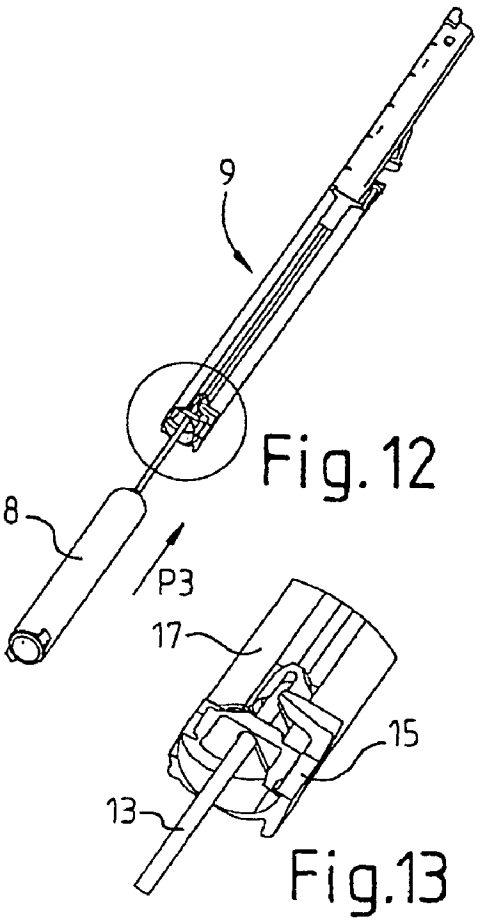
Fig. 12
Fig. 13

DEVICE FOR INFLUENCING THE MOVEMENT OF FURNITURE PARTS WHICH CAN BE MOVED RELATIVE TO ONE ANOTHER, AND DRAWER GUIDE, AND METHOD OF PRODUCING THE DEVICE

FIELD OF THE INVENTION

The invention relates to a device for influencing the movement of furniture parts which can be moved relative to one another, to a drawer guide, and to a method for producing same.

BACKGROUND OF THE INVENTION

As far as furniture is concerned, different arrangements are known for influencing the movement of furniture parts which can be moved in relation to one another. For example, use is made of damping, pulling-in or closing arrangements in particular in furniture with drawers, for guiding the same, in doors or shutters with hinges or in other furniture with adjustable furniture parts. Movable furniture parts may be, in particular, drawers, revolving, swivel or sliding doors or shutters and the like.

So-called touch-latch or pressure-type means on furniture are also known, for example, to assist the functioning of movable furniture parts. The relevant devices here usually comprise a plurality of individual elements.

In order to ensure that the furniture has a long service life, and that the furniture parts which can be moved in relation to one another function in the same way at all times, even after the furniture parts have executed a large number of movement operations, the device has to be capable of withstanding a high level of mechanical loading in the installed state and guarantee reliable kinematics for the relevant furniture parts.

US 2004/0104650 A1 relates, for example, to a coupling device for a damping element integrated in a pull-out slide set. A damping device and the coupling device are arranged, in this case, between a fixed basic-structure rail and a linearly movable drawer rail. One part of the damping device, which comprises a cylinder and a piston rod which can be moved linearly in a damped manner therein, is connected to one of the rails. The other part can be coupled to the other rail, by means of the coupling device, at certain times during opening and closure of the drawer.

SUMMARY OF THE INVENTION

The object of the present invention is to provide a device of the type mentioned in the introduction and a method of producing the same, the device being of space-saving construction, functioning reliably and being comparatively straightforward to install and remove.

The invention is based, in the first instance, on a device for influencing the movement of furniture parts which can be moved relative to one another, in particular for drawer guides, having a movement-influencing unit which comprises an installation housing, in which movement-influencing coupling means are accommodated such that they can be displaced at least in a translatory manner, and having a coupling element, to which the coupling means are connected in the operating state, and the coupling between the coupling means and the coupling element is maintained in operation, during movement of the furniture parts which can be moved relative to one another. One significant aspect of the invention is that the movement-influencing unit is designed such that, by virtue of a relative movement between the coupling means and the coupling element in a displacement direction of the coupling means, the coupling means can be coupled to the coupling element to produce a connection which has a predeterminable coupling force. This makes it possible to establish a reliably functioning coupling between the coupling means and the coupling element and by, in particular, the coupling means or the coupling element being moved exclusively in the direction of the respectively other component, in accordance with the translatory displacement movement of the coupling means. This makes it possible to simplify the production, the assembly or the installation and removal or exchange of the device and/or of the relevant components. In particular it is also possible for the parts which have been coupled in this way to be straightforwardly uncoupled by a relative movement between these parts, by for example one part being moved or pushed out counter to the displacement direction, which was decisive for the displacement movement during the coupling operation. This allows the coupling means and/or the coupling element to be installed and removed again on a number of occasions.

The coupling force is intended, in particular, to be such that the coupling means coupled to the coupling element can be carried along by the displacement of the coupling element, e.g. from the position in which the coupling means are retracted into the fixed installation housing, into a position in which the coupling means are retained and from which the coupling means are moved back again, e.g. into the installation housing, during movement damping. For example it is thus necessary for frictional forces occurring at least at the coupling means to be overcome, as the latter are carried along by the coupling element, in particular by adjacent portions of the installation housing. The coupling force is to be understood as meaning, in particular, the force, or maximum holding-together force, at which the components which are coupled to one another, that is to say the coupling means and the coupling element, are uncoupled under tensile loading. The resulting coupling force, or the maximum force which can counteract separating tensile loading, can be predetermined by design or material features and thus, depending on the application case, may be of different magnitudes. These given features can also be used, for example conversely, to set the tensile force at which the components are uncoupled when the connection is subjected to this force, which may likewise be advantageous in certain application cases, for example in order to prevent overloading.

The movement of the coupling means in the displacement direction in order to establish the coupling takes place, in particular, in a guided manner, for example by abutment, for example, against guide portions of the movement-influencing unit, as a result of which the coupling operation can be improved and can readily be carried out by hand. The proposed procedure allows the movement-influencing unit to be constructed advantageously from individual, albeit interacting, modules or components, without any increase in space-related requirements, reduced functioning or more installation difficulty in relation to known devices having to be accepted as a result. The relevant components can be fitted, coupled and removed by way of the straightforward coupling operation, in particular, without any tools or using standard tools and/or with only a small number of manipulations being required. In the case of drawer guides, the device according to the invention can be used to execute this work even without the drawer guide being removed from the basic structure.

It is also the case that the connected components can be straightforwardly uncoupled, for example during operation or for removal, for example by the coupling means being moved counter to the displacement direction selected for the coupling operation. The coupling between the coupling means and the coupling element is usually maintained during operation, but it is also conceivable for the coupling between the coupling means and the coupling element only to be established at certain times during operation, or for these parts to be alternately coupled and uncoupled during operation.

By virtue of the arrangement proposed, the movement-influencing unit can be realized in a comparatively compact manner and with only a small amount of installation space being required, for example it can preferably be integrated in a drawer guide or in guides for other furniture parts such as doors, revolving, swivel and sliding doors or shutters and the like. It is possible here for the coupling element to be, for example, part of an automatic pulling-in mechanism or a spacer, slide or a coupler itself.

In the case of known devices for influencing the movement of furniture parts which can be moved relative to one another, an integrated solution for the coupling means and the coupling element interacting therewith is not possible for space-related reasons. For example, in drawer guides with damping means and an automatic pulling-in mechanism, although it is possible, for example, for the damper to be accommodated in the drawer guide via an accommodating part, for example, of the drawer rail, the automatic pull-in mechanism has to be fastened beneath the drawer rail in order to allow corresponding connection between the damper and the automatic pulling-in mechanism.

Alongside the above-discussed drawer guides with damper and automatic pulling-in mechanism, the movement-influencing device may also comprise other components, e.g. for touch-latch or pressure-type arrangements.

A further aspect of the invention is that the movement-influencing unit is designed such that, by virtue of a relative movement between the coupling means and the coupling element in a displacement direction of the coupling means, the coupling means can be coupled to the coupling element, there being provided a guide arrangement which moves the coupling means and/or the coupling element into a predetermined coupling position in which the coupling means can be coupled to the coupling element. This makes it possible, during assembly or installation, for the coupling means to be connected to the coupling element in a reliable and uncomplicated manner even at locations of the device which can be accessed only with difficulty, if at all. This is because, in order for the coupling means to be suitably oriented in space, they need not be subjected to any direct action or all that is required is for them to be moved in the displacement direction toward the coupling element. For the purpose of displacing the coupling means, the latter may be subjected to action, in particular, at its end which is opposite to the end which can be coupled, this opposite end usually being relatively easily accessible. It is also possible for the coupling means to be moved indirectly, by the installation housing being moved in the displacement direction of the coupling means. The actual precise positioning of the coupling means then takes place automatically.

This is advantageous, in particular, for installation within only a small amount of working space free at the coupling location or in the case of a concealed coupling location. Moreover, it is possible for the coupling means to be displaced, and guided up to the coupling location, in various orientations which are not suitable for coupling purposes. Rough preliminary orientation of the coupling means is possibly necessary prior to these coupling means being displaced. This may result in time being saved during assembly, which is advantageous, in particular, for the production and installation of relatively large numbers of corresponding devices.

The arrangement according to the invention is also advantageous because it is usually necessary, for the actual coupling mechanism between the coupling means and the coupling element, for said coupling means and coupling element to be located in relation to one another with precisely defined orientation, which can be established in a particularly reliable manner by the guide arrangement according to the invention.

It is further proposed that the guide arrangement comprises guide surfaces along which an end portion of the coupling means can slide in order to reach the predetermined coupling position. This makes it possible, in a straightforward and compact manner, for the coupling means to reach the predetermined coupling position precisely.

In an advantageous configuration of the device according to the invention, the coupling means can be rotated in relation to the installation housing, and the guide arrangement is configured such that the end portion of the coupling means can pass into a rotary position which is correct for the coupling position. The ability of coupling means to rotate on an installation housing can readily be established in the case of standard components of movement-influencing devices, for example in the case of pistons which are accommodated in a displaceable manner in a piston housing and have a piston rod which can be rotated about its longitudinal axis. The invention utilizes this property for an additional function, whereby the coupling means or the coupling rod can assume different rotary positions about their/its axis. It is thus also possible for rotation of the coupling means into the coupling position to be linked with an operation for displacing the coupling means. For a modification in accordance with the possible rotary positions, the coupling means can be designed correspondingly, this relating, in particular, to a front end portion of the coupling means, since it is usually the same portion which is utilized for coupling purposes. For example, the coupling means may comprise a rod element which is accommodated centrally in an installation housing, the front end of which can be moved into a certain rotary position for coupling purposes.

A preferred embodiment of the subject matter of the invention is distinguished in that the guide arrangement has helical guide surfaces and/or ones which are sloping in relation to the displacement direction. This makes it possible for the correct rotary position of the coupling means to be set in a reliable and effective manner. In particular this makes it possible in a space-saving manner for the end portion of the coupling means to be moved into the correct rotary position from different rotary positions of the coupling means in each case. The slopes or helical guide surfaces allow incorrect rotary positioning of the coupling means, or of the end portions thereof, to be avoided or corrected.

In a further embodiment of the subject matter of the invention, the guide arrangement comprises a narrowed portion. The correct rotary position of the coupling means can be achieved via a narrowed portion, it being possible, for example, for the coupling means to come into abutment with the walls of this narrowed portion. The narrowed portion makes it possible, in particular, to avoid further rotation of the coupling means in one or both directions of rotation. It is also the case that further movement of the coupling means in the displacement direction cannot thus possibly result in any further rotation of the coupling means. The narrowed portion may be formed such that a rotary movement of the coupling means is ruled out, although movement in the displacement direction is still possible.

The guide arrangement preferably has a through-passage for the end portion of the coupling means, through which the end portion can be guided while maintaining its rotary position which is correct for the coupling position. In this way, the coupling means, once arrived in the correct rotary position, can be guided further in the displacement direction of the coupling means until the coupling position has been reached. In this case, the narrowed portion allows, as it were, preliminary adjustment of the coupling means in order for the latter to be subsequently coupled to the coupling element. The through-passage is configured, for example, as an opening or in a slot-like manner and may be coordinated with the dimensions and contour of the coupling-means portions which engage in the through-passage, and in particular the portions thereof which can be coupled. In addition to an "intercepting function" during rotation of the coupling means, the narrowed portion can additionally perform further functions, for example securing or guiding the coupling means.

It is also advantageous if the coupling means and/or the coupling element are/is configured such that they can be clipped one inside the other during the relative movement. This allows coupling to be achieved quickly and automatically as the two parts are clipped in. Other coupling mechanisms, e.g. latching means, spring-coupling means, hook-in coupling means and the like, are also conceivable. For the purpose of forming, for example, the clip-in mechanism, corresponding portions may be provided integrally with, or separately from, the coupling means and/or the coupling element, for example with an anchoring part. For example, protuberances, spring means or resilient clamps, latching hooks, latching teeth, etc. may be provided for this purpose.

Using the clip-in mechanism or the like, it is readily possible to establish a predeterminable coupling force between the connected components in accordance with the forces which are desired or can be expected during operation. For example, a force-fitting or form-fitting connection between the coupling means and the coupling element may be realized, for example, as a result of the clip-in operation.

The clip-in contour may have, for example, a constricted location with low-level elastic properties which has to be passed, with frictional contact, by a counterpart which is to be coupled, and, once this constricted location has been passed, the counterpart, e.g. part of the coupling means, is intercepted in a mount and coupling is effected. For example, the anchoring contour may establish precisely one coupling position for the coupling means, or a plurality of coupling positions are possible. A force-fitting or form-fitting connection may be established, in particular, in the displacement direction of the coupling means. In directions other than the displacement direction, the end portion of the coupling means may exhibit a comparatively small amount of play in relation to adjacent portions of the anchoring contour. This may be advantageous for production since narrow production tolerances only have to be taken into account in one direction.

It is further proposed that the coupling means and/or the coupling element are/is provided with magnetic means by which it is possible to establish the coupling during the relative movement. This provides for a coupling mechanism which is particularly space-saving and straightforward to produce.

The coupling means and/or the coupling element preferably have/has an anchoring contour by means of which it is possible to establish a plurality of coupling positions between the coupling means and the coupling element one after the other during the relative movement. The coupling can thus be realized in a particularly reliable manner. It is thus possible for uncoupling forces which occur, in particular, briefly during operation, and go beyond a predetermined coupling force, but are not applied deliberately for uncoupling purposes, e.g. for removal, to result in the coupled components being uncoupled from a first or main coupling position, but then to pass into a further coupling position and likewise to be connected there by an, in particular, predetermined coupling force. However, since a correspondingly large uncoupling force usually only occurs briefly during operation, the components thus remain coupled to one another. During the next movement cycle of the movable furniture parts, the first coupling position can be reached again, e.g. by the components springing back into this main coupling position. This can reduce the susceptibility of the device to malfunctioning, e.g. in respect of undesired uncoupling during operation.

It is conceivable, in principle, to swap over the shaping or functioning in respect of the coupling between the two components which are to be coupled, that is to say between the coupling means and the coupling element. It is also possible to have a configuration in which the movement capabilities between the fixed and movable components are swapped over; for example, instead of the coupling element being movable in relation to a housing, it is also possible for the housing to be configured such that it can be moved in relation to the coupling element. It is likewise conceivable for the coupling means to be fixed in relation to the installation housing, which can be moved in relation to the coupling means.

Also proposed is a drawer guide which has a basic-structure rail, which can be fastened on a basic structure, and a drawer rail, which can be fitted on a drawer, and comprises one of the devices as outlined above. This makes it possible to realize the abovementioned advantages for a drawer guide. In the case of the drawer guide, it is also possible to provide at least one central rail between the basic-structure rail and the drawer rail.

It is particularly preferred if the installation housing is arranged at one end of the drawer rail. This is advantageous in respect of the amount of space required, the assembly of the drawer guide and the exchange of the installation housing on the drawer rail or removal of the installation housing from the drawer rail.

Other arrangements of the installation housing and of the coupling element can also be realized in principle. It is preferable for both to be integrated in a guide or rail, for example both on the same rail, e.g. basic-structure, central or drawer rail, or, of the rails mentioned above, on different rails in each case. It is thus possible for one of the parts to be installed, for example, on a slide which can be displaced on one rail and for the other part to be installed on another rail, the two parts, that is to say, for example, the installation housing and coupling element, being connected during operation.

The invention also relates to a method of producing one of the devices mentioned above, in which case, in order to produce a connection with a predetermined coupling force between the coupling means and the coupling element, the coupling means and the coupling element are moved relative to one another in the displacement direction of the coupling means. The connection between the relevant components can thus be established in a straightforward manner, in particular one behind the other, as seen in the longitudinal direction of these components. It is particularly advantageous here if in particular exclusively one of the components which are to be coupled has to be moved in the direction of the respectively other component, which is possible in a quick and straightforward manner, in which case it may be possible for this movement to be linked with a rotary movement of at least one of the two parts. There is no need for any comparatively complicated and precise positioning or installation and removal movements, which possibly require a number of manipulations or the use of tools. The method proposed therefore allows work to be carried out very effectively in particular from the point of view of time.

BRIEF DESCRIPTION OF THE DRAWINGS

An exemplary embodiment of the invention will be explained more specifically with reference to further advantages and details and by way of the following figures, in which, specifically:

FIG. 8 shows an illustration of a first step for coupling the damper to the closing unit according to FIG. 4;

FIG. 9 shows a detail-specific view from FIG. 8;

FIG. 10 shows an illustration of a second step for coupling the damper to the closing unit;

FIG. 11 shows a detail-specific view from FIG. 10;

FIG. 12 shows an illustration of a third step for coupling the damper to the closing unit;

FIG. 13 shows a detail-specific view from FIG. 12;

DETAILED DESCRIPTION

Figure 1:
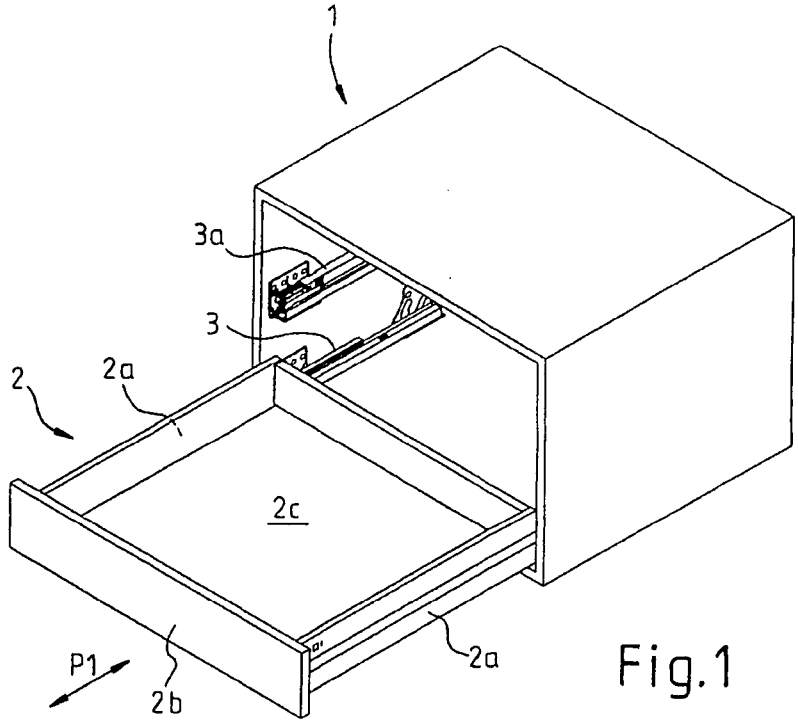
FIG. 1 shows a perspective view, in schematic form, of a basic structure in which a drawer is accommodated via drawer guides according to the invention.

FIG. 1 shows, in a view as seen obliquely from above, a piece of furniture which comprises a basic structure 1 and a drawer 2 which is guided in a movable manner therein. The drawer 2, which is arranged in the bottom region of the basic structure 1, is illustrated in the open or pulled-out state, it being possible for the furniture parts 1 and 2, which can be moved in relation to one another, to be displaced in relation to one another via a pull-out fitting or a drawer guide 3. A further drawer (not illustrated) can be accommodated in the basic structure 1 in the same way via a further drawer guide 3*a*. The drawer 2 can be displaced relative to the basic structure 1 in the direction of the double arrow P1. For the purposes of securing the drawer 2 and guiding the movement thereof, an identical drawer guide 3 or 3*a* is accommodated in each case in the bottom region of drawer frame members 2*a*, which project upward from a drawer base 2*c* on both sides, FIG. 1 showing the drawer guide 3 or 3*a* only on one inner side of the basic structure.

Figure 2:
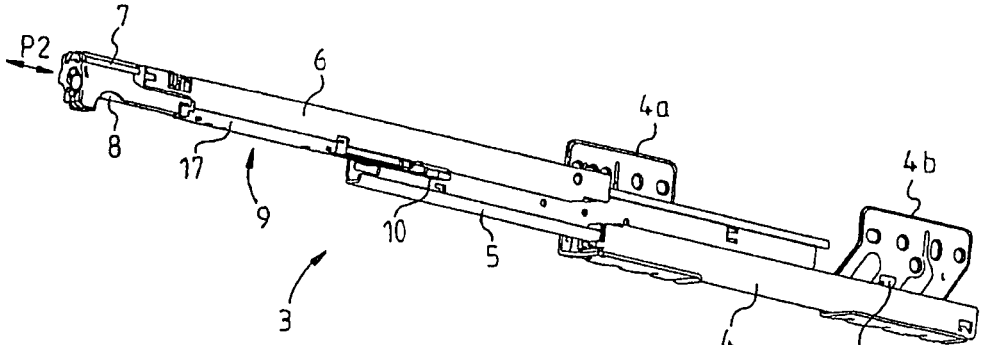
FIG. 2 shows one of the drawer guides shown in FIG. 1, this drawer guide having a damper and a closing unit and being in the extended state.

The extended drawer guide 3, which is illustrated on its own in FIG. 2, corresponds to the drawer guide 3 which is shown in FIG. 1. The drawer guide 3 may basically be configured, for example, to be pulled out all or part of the way and, in the example shown, comprises a basic-structure rail 4, which can be fixed to the basic structure 1 via basic-structure angle 4*a*, 4*b*, a central rail 5 and a drawer rail 6, the drawer rail 6 being fastened on the drawer 2 in each case in the bottom region of the corresponding drawer frame member 2*a*. The rails 5 and 6 are guided such that they can be displaced in relation to one another in the direction of the double arrow P2, and the same applies to the central rail 5 in relation to the basic-structure rail 4.

For the purpose of damping the pushing-in movement of the drawer 2, the drawer guide 3 comprises a damper 8 which is mounted in a multifunctional part 7 and is connected indirectly to the drawer rail 6. The multifunctional part 7 forms an end extension of the drawer rail 6 at the front end of the latter, this front end being directed toward a front panel 2*b* (see FIG. 1) of the drawer 2. This is advantageous for access, in particular, to the damper 8, the multifunctional part 7 and a closing unit 9, e.g. for installation and removal thereof, since the drawer guide, for this purpose, can remain installed on the basic structure 1 and these parts are easily accessible when the drawer guide 3 is extended.

Downstream of the multifunctional part 7, as seen in the longitudinal direction of the latter, the closing unit 9 or an automatic pulling-in mechanism is fitted on the underside of the drawer rail 6. The closing unit 9 comprises a spacer 16 which is mounted such that it can be displaced along the drawer rail 6 and has a coupler 10 fastened at its end which is remote from the damper 8. As the rails 4, 5, 6 are pushed one inside the other, the coupler 10 can intercept a driver 11 on the basic-structure rail 4 and, connected in this way in the installed state, can pull the drawer 2 into its closed position with the aid, for example, of a tension spring 14 (see FIG. 3) or of a compression spring.

Instead of the damper 8 or of the closing unit 9, it is also possible for other components, e.g. a touch-latch system or a pressure-type arrangement, to be installed in a corresponding manner. If these parts have, for example, geometries or dimensions like the damper 8 or the closing unit 9, it is possible to utilize the same multifunctional part 7 and the same drawer rail 6 and corresponding parts can readily be exchanged.

On account of the geometry and the space provided, the damper 8 and the closing unit 9 may be arranged one behind the other, one beneath the other, one beside the other or in an offset manner in relation to one another, etc.

Figure 3:
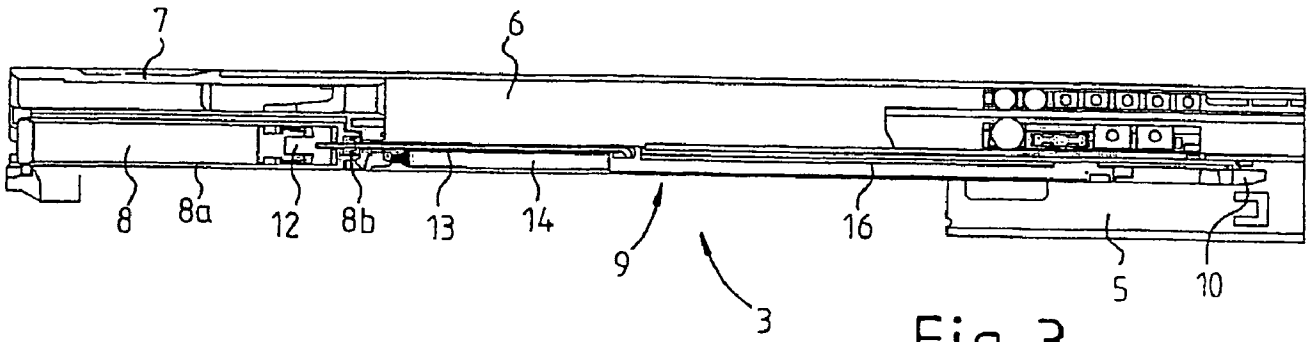
FIG. 3 shows a detail-specific view from the side of the drawer guide shown in FIG. 2, parts of the drawer guide having been left out in order to illustrate specifics to good effect.

FIG. 3 shows a detail-specific view of the drawer guide 3 from the side. Guided in a displaceable manner in a housing 8*a* of the damper 8 is a piston 12, on which is fixed a piston rod 13 which extends centrally, in relation to the damper housing 8*a*, through a damper-housing head 8*b* of the damper 8. In the exemplary embodiment shown, the damper-housing head 8*b* is positioned on the outside of a cover 15 of the closing unit 9, as will be explained in more detail herein below, in particular in relation to FIG. 7. It would also be possible, however, for the damper-housing head 8*b* to be mounted via the multifunctional part 7, if the latter is extended correspondingly.

Figure 4:
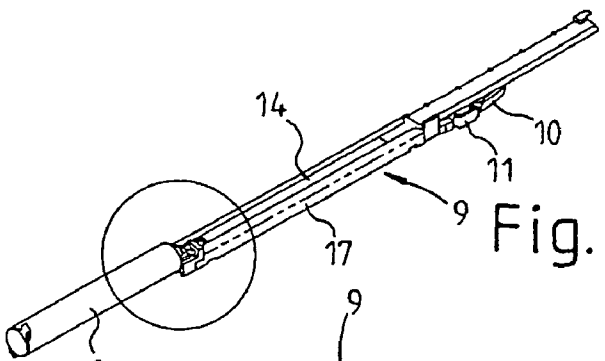
FIG. 4 shows a perspective illustration of a damper with closing unit in the pulled-in position.
Figure 5:
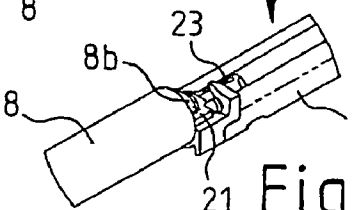
FIG. 5 shows a detail from FIG. 4.

In FIGS. 4 and 5, which illustrate on an enlarged scale the detail circled in FIG. 4, the damper 8 and the closing unit 9 are shown on their own in the coupled and pulled-in position. The damper 8 and the closing unit 9 are positioned one behind the other, as seen in their longitudinal direction. The driver 11, which is shown in FIG. 4, has been removed from the basic-structure rail 4 and has the coupler 10 gripping around it. The coupler 10 is connected to the spacer 16 in a pivotable manner for example via a plug-in connection, this spacer being arranged in a longitudinally displaceable manner in a housing 17 of the closing unit 9.

Figure 6:
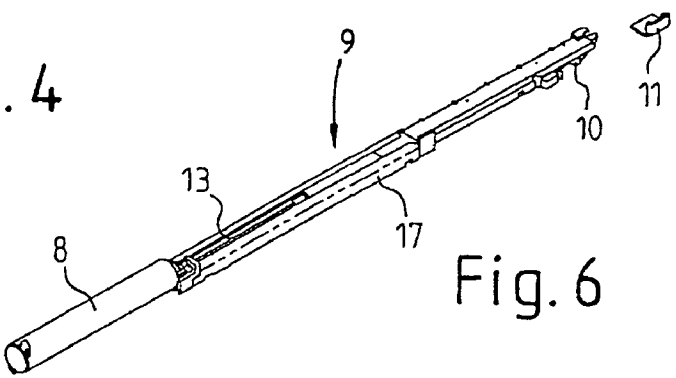
FIG. 6 shows the damper with closing unit according to FIG. 4 in the pulled-out position.

The parts which are illustrated in FIG. 4 are shown in FIG. 6 in the pulled-out position or with the piston rod 13 extended and the spacer 16 extended in relation to the housing 17. The driver 11 is located at a distance downstream of the coupler 10 of the closing unit 9.

Figure 7:
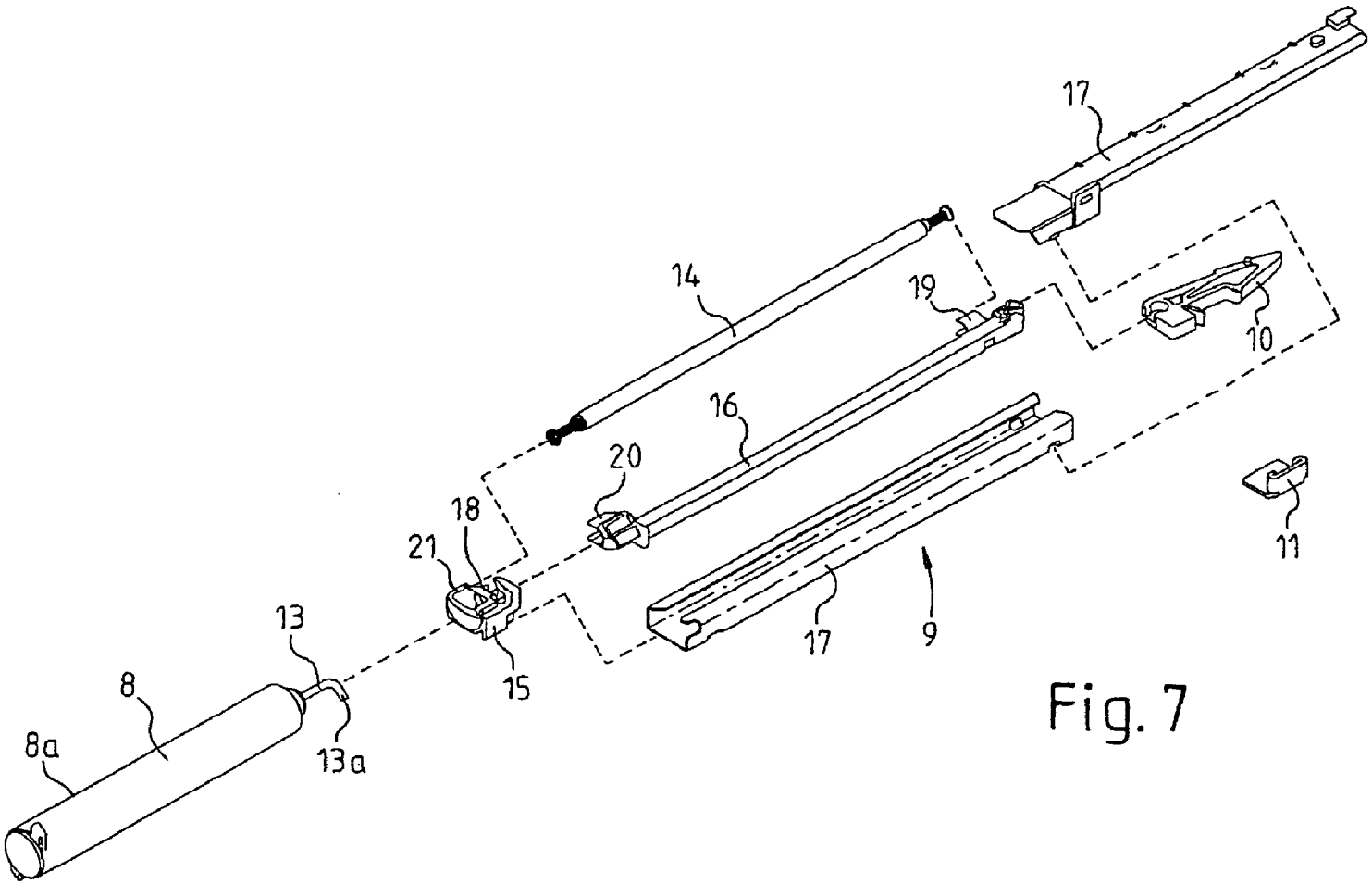
FIG. 7 shows an exploded illustration of the damper with closing unit according to FIG. 4.
Figure 14:
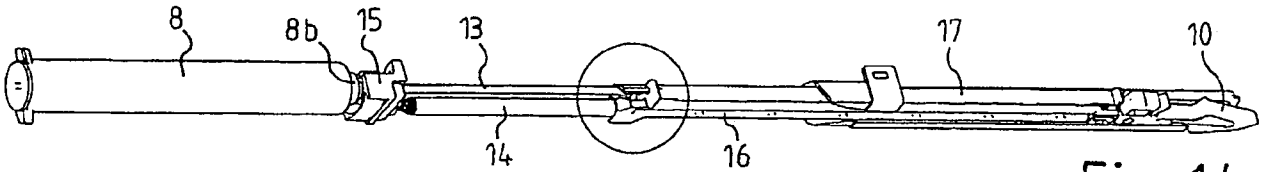
FIG. 14 shows an illustration of a fourth step for coupling the damper to the closing unit, some housing parts having been omitted.

FIG. 7 shows, alongside the damper 8, the individual parts of the closing unit 9 in the pulled-in position, and their positioning in relation to one another in the assembled state, with the aid of interrupted dashed lines. The driver 11 is also illustrated. The housing 17 of the closing unit 9 is of multi-part or two-part design here. A tension spring 14, which is subjected to, and relieved of, stressing as the spacer 16 is displaced, has one end fixed on the cover 15 by way of a securing means 18 and at the other end is fixed to the spacer 16 via a securing means 19.

The tension spring 14 can be fitted, in principle, between fixed parts, e.g. the cover 15, rail 6, damper housing 8*a* or multifunctional part 7, and parts which can be moved in particular in relation to the rail 6, e.g. the spacer 16, coupler 10 and the like. The length of the spacer 16 is thus also dependent on the length and positioning of the tension spring 14.

The rear end of the spacer 16 serves, inter alia, for positioning purposes in the housing 17 and has a grip-around means 20 for the guidance of the tension spring 14. The spacer 16 can be displaced linearly in the housing 17. The damper 8 has its damper-housing head 8*b* projecting into a damper-housing-head mount 21 in the cover 15.

At its front end, the piston rod 13 has an angled portion 13*a* in the form of an endpiece which is bent approximately at right angles. The angled portion 13*a* does not extend, as seen radially in relation to the piston rod 13, to a radius determined by an outer side of the damper housing 8*a*, which is advantageous, in particular, for reasons relating to space and installation.

FIGS. 8 to 17 depict the successive installation steps for assembling the parts shown, these figures not including, in particular, the multifunctional part 7 or the drawer rail 6. FIGS. 9, 11 and 13 show on an enlarged scale the details circled in FIGS. 8, 10 and 12.

Installation of the damper 8 on the multifunctional part 7 and coupling to the spacer 16 can take place, in principle, before or after the drawer guide 3 is fitted on the furniture parts 1, 2. When the damper 8 is guided up to the closing unit 9 or the cover 15 according to FIGS. 8 and 9, the piston rod 13 is preferably located in the position in which it is pulled out in relation to the damper housing 8*a*, and the closing unit 9 is preferably located in the pulled-in position. However, it is also possible, in principle, for the damper 8 to be installed and/or coupled in all other positions or states of the drawer guide, in particular even when the piston rod 13 has been pushed in because, even in the fully pushed-in position, the front end of the piston rod 13 with the angled portion 13*a* projects far enough outward on the damper-housing head 8*b* and is free for coupling to the spacer 16.

There is no need for the angled portion 13*a* to be adjusted precisely into a rotary position prior to the damper 8 being guided up to the cover 15 or the spacer 16; all that is required is for the angled portion 13*a* to be located within a push-in range of approximately 180 degrees on the cover 15, which will become more apparent hereinbelow. Otherwise, the damper 8 is prevented from being pushed all the way into the multifunctional part 7, by the angled portion 13*a* striking, for example, against a stop on the multifunctional part 7. This means that virtually no effort is required to set the rotary position of the piston rod 13 in the damper housing 8*a*. All that is required is for the angled portion 13*a* to be located in a rotary position within a range of approximately 180 degrees such that it can come into contact with a control surface 24 on the cover 15. This takes place by the damper 8 being moved relative to the closing unit 9 in the direction of the arrow P3 according to FIG. 8. The control surface 24 is designed, for example, as a sloping surface which slopes down in the direction of the arrow P3, e.g. in helical form, which is bounded on the outside by a cylindrical inner wall 25 of the cover 15.

The angled portion 13*a*, for example according to FIGS. 8 and 9, is oriented in the approximately "8 o'clock" position in pushing-in direction P3. The angled portion 13*a* is in abutment against the control surface 24 in direction P3, it being possible for the radially outwardly directed, circular end surface of the angled portion 13*a* to come into contact with the inner wall 25. If the damper 8 is then moved further in the direction P3, the angled portion 13*a* is moved along the control surface 24 and, at the same time, rotated in relation to the damper housing 8*a* in the direction of the arrow P4 according to FIG. 10, as a result of which the angled portion 13*a* is set in an approximately "4 or 5 o'clock" rotary position which is illustrated in FIG. 11.

By virtue of the piston rod 13 and the cover 15 being configured according to the invention, the action of guiding the damper 8 up to the cover 15 or the closing unit 9 in the longitudinal direction of the damper 8 causes the piston rod 13 to be rotated in the counterclockwise direction. With the correspondingly configured control surface, it is basically also possible for rotation to take place in the clockwise direction. Combining the displacement and rotary movements makes it possible to set a correctly positioned rotary orientation for the piston rod 13 and, at the same time, for the parts which are to be coupled to be moved in direction P3 in relation to one another.

As the damper 8 is moved further in direction P3, the angled portion 13*a* engages, in the rotary position reached, or in the approximately "4 or 5 o'clock" position (FIGS. 10 and 11), in a slot 22, at which the control surface 24 terminates. From that position of the piston rod 13, or of angled portion 13*a*, which is reached in FIGS. 10 and 11, the angled portion 13*a*, as a result of further movement of the damper 8 in direction P3 (see FIG. 12), passes through the slot 22 and moves on into a slot 23 in the spacer 16, which is located downstream of the slot 23 as seen in the displacement direction. In the position where the angled portion 13*a* is secured in the slot 23, this position being shown in FIG. 13, the angled portion 13*a* or the piston rod 13 can be coupled to the spacer 16, because the angled portion 13*a* leads through the slot 22 into the slot 23, which are oriented appropriately in relation to one another or are aligned with one another. The actual, in particular, force-fitting or form-fitting coupling of the piston rod 13 to the spacer 16 then takes place in the slot 23.

FIGS. 14 to 17 depict the coupling mechanism or the angled portion 13*a* latching into the spacer 16. The closing unit 9 is illustrated in the pulled-out position here, and parts of the housing 17 have been left out. Two protuberances 26, 27 are configured as cross-sectionally approximately frustoconical elevations (see also FIG. 18) on one wall of the approximately U-shaped slot 23 of the spacer 16. The other wall is of planar configuration, although it may also be contoured for a coupling or latching geometry. In the direction in which the angled portion 13*a* is plugged into the slot 23, the protuberances 26, 27 are configured as transversely running elevations over which that endpiece of the piston rod 13 which is formed by the angled portion 13*a* has to be moved in order to reach the coupling position. For this purpose, at least the protuberances 26, 27 may consist of a correspondingly approximately compliant or elastic material, e.g. from elastomeric material or a rubbery material. The protuberances 26, 27 are followed in each case by a depression 26*a*, 27*a* in the manner of a double wave. Downstream of the rear protuberance 27, as seen in the direction in which the angled portion 13*a* is plugged into the slot 23, the depression 27*a* is configured for accommodating the angled portion 13*a* in its final position, a stop surface 28 limiting or defining maximum depth to which the angled portion 13*a* can be pushed into the slot 23. In order for the angled portion 13*a* to slide reliably into the slot 23, the latter may be configured on the opening side, through which the angled portion 13*a* enters, with a bevel, in the pushing-in direction, on the wall located opposite the protuberances 26, 27.

Figure 16:
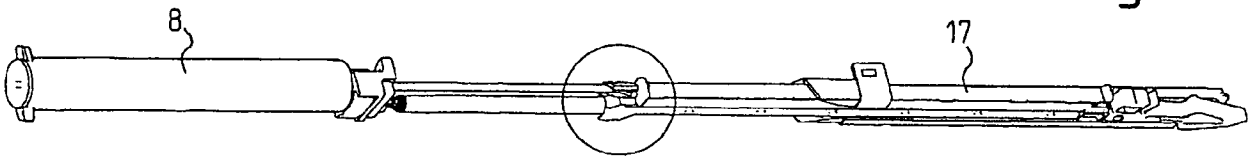
FIG. 16 shows an illustration of a fifth step for coupling the damper to the closing unit, some housing parts having been omitted.
Figure 15:
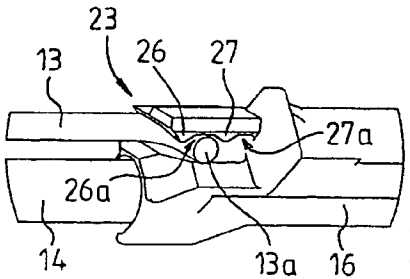
FIG. 15 shows a detail-specific view from FIG. 14.
Figure 17:
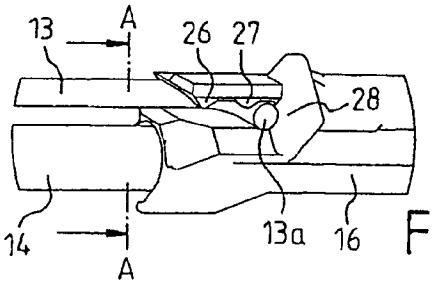
FIG. 17 shows a detail-specific view from FIG. 16.
Figure 18:
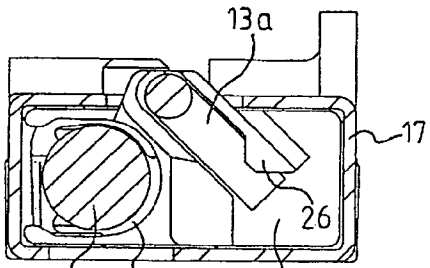
FIG. 18 shows a cross section through the closing unit and the damper installed in one another, the cross section being taken along line A-A in FIG. 17, but including some housing parts left out of FIG. 17.

The retaining force between the piston rod 13 and the spacer 16 which is established by way of the state which is shown in FIGS. 16 and 17 can be set in accordance with the geometry or the dimensions of the slot 23 and/or of the protuberances 26, 27 and the angled portion 13*a*, it also being possible for one protuberance to be sufficient. This set-up reliably realizes, in particular, a coupling force which is necessary for displacing the piston rod 13 in a translatory manner out of the damper housing 8*a* when the spacer 16 is pulled out of the housing 17, which is the case, for example, during the operation of opening the drawer 2 with the drawer guide 3.

Configuring the slot 23 with two protuberances 26, 27 makes it possible to achieve the situation where, for example, the piston rod 13 and the spacer 16 can be coupled even if the piston rod 13 does not come into contact with the abutment surface 28 once it has been plugged into the slot 23. If the angled portion 13*a* is located, for example, between the protuberances 26 and 27, in the depression 26*a*, the retaining force is provided, in particular, by the resistance formed by the front protuberance 26 or the narrowed location in the slot 23 established thereby. If the drawer 2 is then closed, the angled portion 13*a* can be forced, via the rear protuberance 27, into the depression 27*a* and thus arrive in the definitive coupling position against the stop surface 28. Moreover, configuring the slot 23 with two protuberances 26, 27 is advantageous when forces by way of which the angled portion 13*a* can slide over the rear protuberance 27, but remains coupled in the depression 26*a* upstream of the protuberance 26, take effect, for example, briefly as the drawer 2 is opened, since this results in a further resistance which then usually keeps the piston rod 13 or the angled portion 13*a* in the coupling position in the slot 23. During the next closing movement, the angled portion 13*a* can thus pass back again into the rear coupling position downstream of the protuberance 27. This minimizes the susceptibility to malfunctioning during operation as a result of the piston rod 13 uncoupling from the spacer 16. Also conceivable, in principle, are further protuberances or other types of inner contour for the slot 23 or clamping or latching means in the slot 23.

LIST OF DESIGNATIONS

1 Basic structure
2 Drawer
2*a* Drawer frame member
2*b* Front panel
2*c* Drawer base
3 Drawer guide
3*a* Drawer guide
4 Basic-structure rail
4*a* Basic-structure angle
4*b* Basic-structure angle
5 Central rail
6 Drawer rail
7 Multifunctional part
8 Damper
8*a* Damper housing
8*b* Damper-housing head
9 Closing unit
10 Coupler
11 Driver
12 Piston
13 Piston rod
13*a* Angled portion
14 Tension spring
15 Cover
16 Spacer
17 Housing
18 Securing means
19 Securing means
20 Grip-around means
21 Damper-housing-head mount
22 Slot
23 Slot
24 Control surface
25 Inner wall
26 Protuberance
26*a* Depression
27 Protuberance
27*a* Depression
28 Stop surface

What is claimed is:

1. Device for influencing the movement of furniture parts which can be moved relative to one another having a movement-influencing unit which comprises an installation housing, in which movement-influencing coupling means are accommodated such that they can be displaced at least in a translatory manner wherein the coupling means extends from the installation housing, and having a coupling element, to which the coupling means are connected in an operating state wherein a structure rail and a drawer rail are engaged, and the coupling between the coupling means and the coupling element is maintained in the operating state, during movement of the structure rail and the drawer rail which can be moved relative to one another, wherein the movement-influencing unit is configured such that by a relative movement between the coupling means and the coupling element in a displacement direction of the coupling means, the coupling means can be coupled to the coupling element to produce a connection which has a predeterminable coupling force, wherein a guide arrangement comprising helical guide surfaces rotates the coupling means to produce the connection.

2. Device according to claim 1, wherein the coupling means and the coupling element are configured such that one can be clipped inside the other during the relative movement.

3. Device according to claim 1, wherein at least one of the coupling means or the coupling element has an anchoring contour which establishes a plurality of coupling positions between the coupling means and the coupling element one after the other during the relative movement.

4. Drawer guide having a structure rail, which can be fastened on a structure, and a drawer rail, which can be fitted on a drawer, comprising a device according to claim 1.

5. Drawer guide according to claim 4, wherein the installation housing is arranged at one end of the drawer rail.

6. Device for influencing the movement of furniture parts which can be moved relative to one another having a movement-influencing unit which comprises an installation housing, in which movement-influencing coupling means are accommodated such that they can be displaced at least in a translatory manner, and having a coupling element, to which the coupling means are connected in the operating state, and the coupling between the coupling means and the coupling element is maintained in operation, during movement of the furniture parts which can be moved relative to one another, wherein the movement-influencing unit is configured such that by a relative movement between the coupling means and the coupling element in a displacement direction of the coupling means, the coupling means can be coupled to the coupling element, there being provided a guide arrangement which moves at least one of the coupling means or the coupling element into a coupling position in which the coupling means can be coupled to the coupling element, wherein the guide arrangement comprises helical guide surfaces along which an end portion of the coupling means can slide in order to reach the coupling position; and wherein the coupling means is rotated in relation to the installation housing when the end portion of the coupling means slides upon the helical guide surfaces.

7. Device according to claim 6, wherein the guide arrangement is configured such that the end portion of the coupling means can slide into a rotary position which is correct for the coupling position.

8. Device according to claim 6, wherein the guide arrangement comprises a narrowed portion.

9. Device according to claim 6, wherein the guide arrangement has a through-passage for the end portion of the coupling means, through which the end portion can be guided while maintaining its rotary position which is correct for the coupling position.

10. Device according to claim 6, wherein the coupling means and the coupling element are configured such that one can be clipped inside the other during the relative movement.

11. Device according to claim 6, wherein at least one of the coupling means or the coupling element has an anchoring contour which establishes a plurality of coupling positions between the coupling means and the coupling element one after the other during the relative movement.

12. Drawer guide having a structure rail, which can be fastened on a structure, and a drawer rail, which can be fitted on a drawer, comprising a device according to claim 6.

13. Device according to claim 6, wherein as the end portion of the coupling means slides upon the helical guide surfaces, the rotation of the coupling means is substantially perpendicular to the displacement direction of the coupling means.

* * * * *